United States Patent [19]

van der Molen

[11] 4,172,710

[45] Oct. 30, 1979

[54] VACUUM CLEANER

[75] Inventor: Jacobus H. van der Molen, Groningen, The Netherlands

[73] Assignee: U.S. Philips Corporation, New York, N.Y.

[21] Appl. No.: 854,780

[22] Filed: Nov. 25, 1977

[30] Foreign Application Priority Data

Dec. 3, 1976 [NL] Netherlands ..... 7613475

[51] Int. Cl.[2] ..... B01D 45/14; A47L 9/16

[52] U.S. Cl. ..... 55/340; 55/339; 55/403; 55/409; 55/337; 55/470; 55/DIG. 3; 15/353

[58] Field of Search ..... 55/339, 401, 403, 408, 55/409, 459 R, DIG. 3, 340, 337, 470, 472; 15/353; 209/144

[56] References Cited

U.S. PATENT DOCUMENTS

| | | | |
|---|---|---|---|
| 2,188,031 | 1/1940 | Brock | 55/403 |
| 2,372,514 | 3/1945 | Pootjes | 209/144 |
| 2,498,832 | 2/1950 | Watson et al. | 209/144 |
| 3,174,264 | 3/1965 | McKnab | 55/401 |
| 3,234,716 | 2/1966 | Sevin et al. | 55/401 |

FOREIGN PATENT DOCUMENTS

| | | | |
|---|---|---|---|
| 719129 | 10/1965 | Canada | 55/339 |
| 1482454 | 7/1971 | Fed. Rep. of Germany | 55/339 |

*Primary Examiner*—David L. Lacey

*Attorney, Agent, or Firm*—Thomas A. Briody; William J. Streeter; Rolf E. Schneider

[57] ABSTRACT

A vacuum cleaner comprising a first whirl chamber for receiving dust-laden air and separating heavy and light dust particles therefrom, a second whirl chamber communicating at its inlet end with said first whirl chamber for receiving air therefrom and concentrating very light dust particles in said air, an intermediate chamber arranged at the outlet end of the second whirl chamber for receiving the very light dust particle-containing air therefrom, and a separate air-passage connection between the intermediate chamber and the first whirl chamber for return of said very light dust particle-containing air thereto.

4 Claims, 4 Drawing Figures

VACUUM CLEANER

Figure 1:
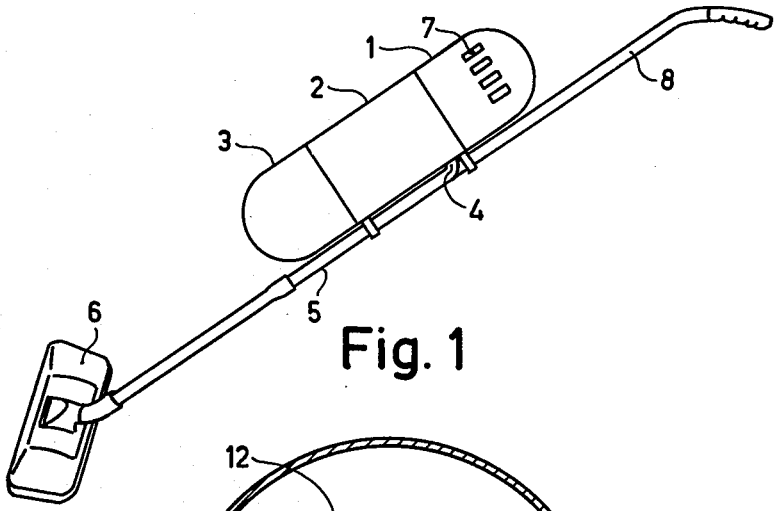

This invention relates to a vacuum cleaner having a whirl chamber, a motor-driven compressor, air inlet opening in the whirl chamber, a dust collection compartment and an air outlet opening.

Such a vacuum cleaner is known from British Pat. No. 568,242. In this vacuum cleaner the air enters the whirl chamber tangentially, so that a rotating air current is obtained. Owing to the centrifugal force heavier dust particles are extracted from the air which is discharged from the whirl chamber. The resulting air current containing lighter dust particles is subsequently passed through a filter. The clean air is discharged by the compressor via outlet openings. The disadvantage of this vacuum cleaner is that a filter is needed to remove the lighter dust particles from the current of air. This filter has to be cleaned at regular intervals.

It is the object of the invention to provide a solution for this difficulty. According to the invention, a second whirl chamber is provided in which vanes are arranged which impart a rotary motion in the air, and which second whirl chamber at its inlet side directly communicates with the first whirl chamber and at its outlet side has a centrally disposed outlet through which air is passed to the compressor and an annular opening situated around said outlet for feeding back air to the first whirl chamber.

The second whirl chamber effects the separation of further dust particles from the air. Owing to the centrifugal action the rotating air current near the inner wall of the second whirl chamber contains all lighter dust particles. By feeding back this current of air to the first whirl chamber such dust particles can be extracted from the air by the centrifugal action. This process may be repeated several times.

In a preferred embodiment the annular opening constitutes the inlet opening of an intermediate chamber, in which a motor-driven impeller is located, which intermediate chamber has a separate air connection with the first whirl chamber. The impeller in the intermediate chamber possesses the advantage that the rotating dust laden air current near the inner wall of the second whirl chamber is suitably drawn into the intermediate chamber and is subsequently discharged into the first whirl chamber via the separate connection so as to amplify the whirling action in this latter chamber.

A further embodiment is arranged so that the impeller of the compressor has an intake tube which extends through the intermediate chamber into the second whirl chamber and comprises the outlet from such whirl chamber.

In still a further embodiment the impeller which is located in the intermediate chamber is secured to the outer wall of such intake tube.

A specific embodiment is arranged such that the second whirl chamber is centrally disposed in the first whirl chamber and the intermediate chamber adjoins the first whirl chamber, the separate connection being constituted by openings formed in a partition between the first whirl chamber and the intermediate chamber.

In another specific embodiment the second whirl chamber, the intermediate chamber, and the compressor are assembled to form a unit, which is arranged separately from the first whirl chamber, the separate connection between the first whirl chamber and the intermediate chamber comprising a duct which is tangentially joined to the first whirl chamber.

Preferably the vanes in the second whirl chamber are driven by the compressor motor.

Figure 2:
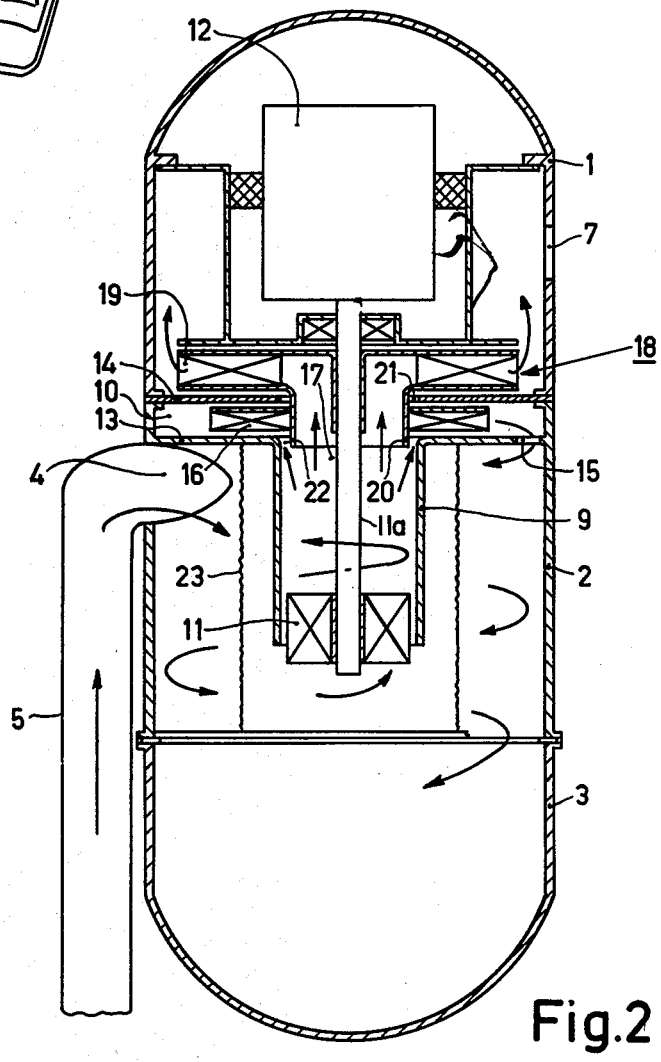
Figure 3:
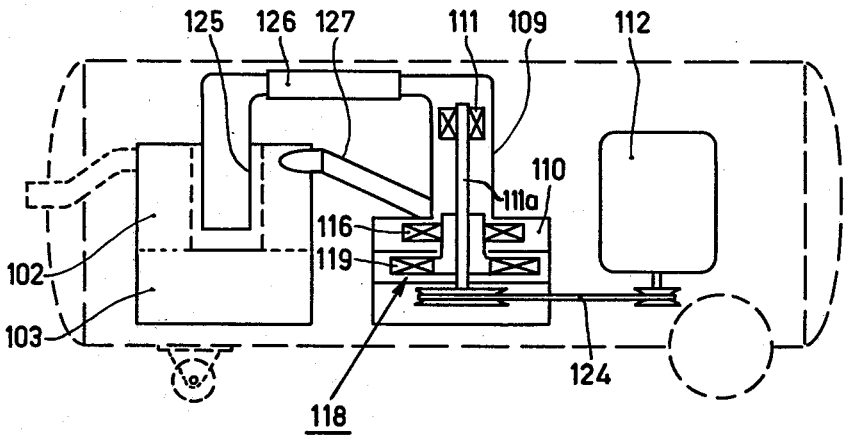
Figure 4:
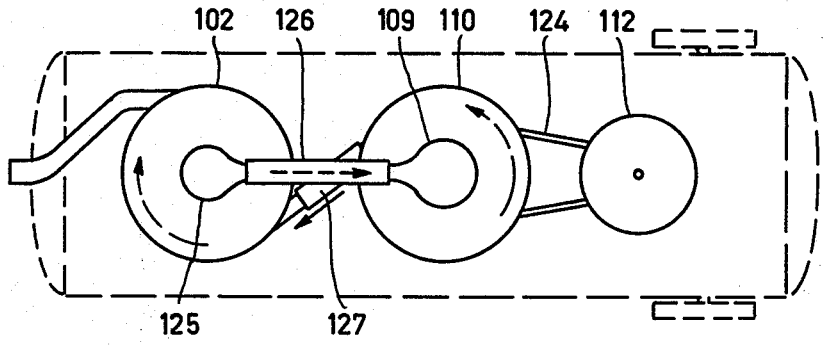

The invention will now be described in more detail with reference to the accompanying drawings, in which FIG. 1 is a perspective view of an upright vacuum cleaner, FIG. 2 is a schematic cross-section on an enlarged scale of the vacuum cleaner of FIG. 1, FIG. 3 schematically represents the invention applied to a tank vacuum cleaner, and FIG. 4 is a plan view of FIG. 3.

The upright vacuum cleaner of FIGS. 1 and 2 comprises a motor housing 1, a first whirl chamber 2, and a detachable dust collector 3. At the top an air inlet opening 4 is formed in the whirl chamber 2, in which a suction tube 5 terminates. A nozzle 6 is attached to the lower end of the suction tube 5. In the motor housing 1 air outlet openings 7 are formed. Furthermore, a handle 8 with a grip is mounted at the top of the vacuum cleaner.

A second whirl chamber 9, which has a tubular form, extends into the first whirl chamber 2 and is in open communication with an intermediate chamber 10. In the second whirl chamber 9 an impeller 11 is mounted on motor shaft **11*a* at the intake side, which impeller is driven by the motor 12. The intermediate chamber 10 is formed by the partition 13, the partition 14 and the inner wall of the vacuum cleaner housing. The intermediate chamber 10 and the first whirl chamber 2 are in communication with each other by means of openings 15 in the partition 13. An impeller 16 which is driven by the motor 12 is situated in the intermediate chamber 10. The second whirl chamber 9 has a central outlet 17 through which air is passed to the compressor 18. For this purpose a central intake tube 20 is placed on the impeller 19 of the compressor 18. The intake tube 20 extends through the intermediate chamber 10 into the second whirl chamber 9. For this purpose a central opening 21 is formed in the partition 14. Between the intake tube 20 and the second whirl chamber 9 an annular opening 22 is formed. The impeller 16 is secured to the outer wall of the intake tube 20. A coarse filter 23 is disposed concentrically around the second whirl chamber 9 and over the full length of the first whirl chamber 2**.

The operation of the vacuum cleaner is as follows: Through the inlet opening 4 dust-laden air is drawn into the first whirl chamber 2. Both the impeller 11 and the impeller 16 produce a rotating air current in the first whirl chamber 2. The heavy and light dust particles contained in the current of air remain near the inner wall of the first whirl chamber 2 owing to the centrifugal force. The very light dust particles are drawn into the second whirl chamber 9 through the coarse filter 23. The coarse filter prevents large dust particles and items such as paper clips and buttons from damaging the impellers. The impeller 11 produces a rotating air current so that all the very light dust particles are moved to the inner wall of the second whirl chamber 9 in order to separate additional dust particles. The length of the second whirl chamber 9 must be sufficient to assure that all the very light dust particles reach the inner wall of the second whirl chamber. The air current with all the very light dust particles leaves the second whirl chamber through the annular opening 22, enters the intermediate chamber 10 and is circulated back into the first whirl chamber 2 via openings 15. The impeller 16 amplifies the whirling action. The whirling action in the first whirl chamber is such that even the very light dust particles which have been fed back remain near the inner wall of the whirl chamber. By returning a part of the air current to the first whirl chamber all dust particles are also led in the direction of the dust collector 3 where they settle. The clean air leaves the vacuum cleaner via intake tube 20, compressor 18 and outlet openings 7.

In order to boost the whirling action in the first whirl chamber the air is preferably tangentially drawn into the first whirl chamber through the inlet opening.

For use of the invention in a tank vacuum cleaner the vacuum cleaner housing of the upright vacuum cleaner described hereinbefore may be arranged horizontally. However, this requires a different construction of the dust collector.

Such a construction, in which the dust collector can be the same as in the upright vacuum cleaner and in which gravity moreover has a favorable effect on the vacuum cleaner action, is schematically shown in FIGS. 3 and 4. The vertically disposed first whirl chamber 102 with dust collector 103 is arranged separately from the second whirl chamber 109, the intermediate chamber 110 and the compressor 118 which are also disposed vertically. The impellers 111, 116 and 119 are mounted on shaft 111*a* and are driven by the motor 112 via a belt 124. The duct 125 which extends from the first whirl chamber 102 is connected to the second whirl chamber 109 via a conduit 126. The air current laden with dust particles near the inner wall of the intermediate chamber 110 is tangentially discharged from the intermediate chamber 110 and is tangentially fed back into the first whirl chamber 102 via a separate conduit 127, so that minimal loss of air speed is assured. Otherwise, the operation of this vacuum cleaner is similar to that of the upright vacuum cleaner described hereinbefore.

What is claimed is:

1. A vacuum cleaner which comprises a first whirl chamber, a motor, a compressor impeller rotatably driven by said motor to pull air through said first whirl chamber, means to introduce air laden with heavy, light, and very light dust particles into said first whirl chamber in a manner to impart a rotary motion to said air to substantially separate the heavy and light dust particles therefrom, a dust-collection compartment positioned and arranged with respect to said first whirl chamber for reception of said separated dust particles, a second whirl chamber having an inlet end and an outlet end, said inlet end communicating with said first whirl chamber, vanes rotatably mounted to said motor and positioned in the inlet end of said second whirl chamber to impart a rotary motion to the very light dust particle-laden air entering thereinto, said vanes being driven by said motor, the length of said second whirl chamber being sufficient to assure that all of the very light dust particles reach the inner wall of said second whirl chamber, an intermediate chamber arranged at the outlet end of said second whirl chamber for reception of the very light dust particle-containing air, a separate impeller rotatably mounted to said motor and positioned in said intermediate chamber and driven by said motor, said second whirl chamber having at its outlet end a centrally disposed outlet tube extending through said intermediate chamber for passage of substantially dust-free air to the compressor impeller, an annular opening situated around said outlet tube and communicating with said intermediate chamber, and air-passage means separately connecting said intermediate chamber with the first whirl chamber for return of the very light dust particle-containing air thereto.

2. A vacuum cleaner according to claim 1, in which the separate impeller is secured to the centrally disposed outlet tube.

3. A vacuum cleaner according to claim 1, in which the second whirl chamber is centrally disposed within the first whirl chamber, the intermediate chamber is separated from the first whirl chamber by a partition, and the separate air-passage connecting means between the intermediate chamber and the first whirl chamber air-passage openings formed in said partition.

4. A vacuum cleaner according to claim 1, in which the second whirl chamber, the intermediate chamber, and the compressor impeller are assembled to form a unit arranged separately from the first whirl chamber, and the separate air-passage connecting means between the intermediate chamber and the first whirl chamber comprises a duct tangentially joined to the first whirl chamber.

* * * * *